US008207804B2

(12) United States Patent
Ohtsuka et al.

(10) Patent No.: US 8,207,804 B2
(45) Date of Patent: Jun. 26, 2012

(54) OPERATING DEVICE THAT PERFORMS OPENING AND CLOSING OPERATIONS OF A SWITCH

(75) Inventors: Kyoichi Ohtsuka, Tokyo (JP); Shuichi Tanigaki, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 323 days.

(21) Appl. No.: 12/468,941

(22) Filed: May 20, 2009

(65) Prior Publication Data

US 2010/0164659 A1 Jul. 1, 2010

(30) Foreign Application Priority Data

Dec. 26, 2008 (JP) ..... 2008-335072

(51) Int. Cl.
*H01H 9/00* (2006.01)

(52) U.S. Cl. ..... 335/174; 200/17 R

(58) Field of Classification Search ..... 335/6, 22, 335/25, 167–172, 174, 177, 185, 189–192, 335/194, 195; 200/17 R–17 B, 400
See application file for complete search history.

(56) References Cited

U.S. PATENT DOCUMENTS

| | | | | |
|---|---|---|---|---|
| 6,348,847 | B1 * | 2/2002 | Nakajima et al. | 335/195 |
| 6,444,934 | B1 * | 9/2002 | Imura et al. | 200/400 |
| 6,610,949 | B2 * | 8/2003 | Mori et al. | 200/400 |
| 2002/0056631 | A1 * | 5/2002 | Ohtsuka et al. | 200/400 |

FOREIGN PATENT DOCUMENTS

| | | | |
|---|---|---|---|
| JP | 63-304542 | A | 12/1988 |
| JP | 09-320407 | A | 12/1997 |
| JP | 10-255601 | A | 9/1998 |

* cited by examiner

*Primary Examiner* — Bernard Rojas
(74) *Attorney, Agent, or Firm* — Buchanan Ingersoll & Rooney PC

(57) ABSTRACT

An operating device performs opening and closing operations of a switch. The operating device includes a lever member that is coupled to a movable contact of the switch and biased by an energy storage spring; a tripping latch that can be engaged with the lever; a tripping trigger that can be engaged with the tripping latch; first and second electromagnets that can operate independently of each other and each of which has a plunger; and a rotating lever that can come into contact with a different portions of the plunger of the first electromagnet, the plunger of the second electromagnet, and the tripping trigger and that is rotated by being pushed by at least one of the plunger of the first electromagnet and the plunger of the second electromagnet, thereby pushing the tripping trigger.

14 Claims, 6 Drawing Sheets

OPERATING DEVICE THAT PERFORMS OPENING AND CLOSING OPERATIONS OF A SWITCH

BACKGROUND OF THE INVENTION

1. Field of the Invention

The present invention relates to an operating device of a switching device or the like including a latch mechanism for maintaining or releasing an operating force.

2. Description of the Related Art

As a conventional operating device, there is a spring operation device that includes a torsion bar as an energy storage source for an operating force, as shown in FIG. 1 of Japanese Patent Application Laid-open No. S63-304542, for example. This conventional operating device has a latch mechanism for maintaining or releasing an operating force of the torsion bar.

Japanese Patent Application Laid-open No. H09-320407, discloses a circuit breaker tripping device (operating device). In this circuit breaker tripping device, an operating mechanism that transmits an operating force to a circuit breaker is maintained in a state of equilibrium when the circuit breaker is in a switched state. When the circuit breaker tripping device receives a cut-off command, the equilibrium of the operating mechanism is broken so that the operating force is transmitted to the circuit breaker. In the latch mechanism of this operating device, to improve the reliability of the operation of the latch mechanism, there are two electromagnets that supply a driving force to trip the latch mechanism, and thus, even when one of the electromagnets has a trouble such as unable to operate, the latch mechanism can be released with the other electromagnet. In this way, redundancy is secured (see FIG. 2 of Japanese Patent Application Laid-open No. H09-320407). Moreover, the operating device is configured with two electromagnets that are arranged in parallel, and the latch mechanism is released when the displacement of a plunger of the electromagnet is transmitted to a latch catch via a displacement-transmitting mechanism.

In this manner, the latch mechanism of the conventional operating device is released when the displacement of the plunger of the two electromagnets arranged in parallel is transmitted to the latch catch via the displacement-transmitting mechanism. However, the structure of this displacement-transmitting mechanism is complicated, because it is configured by a large number of components such as a push-up bar, a thrust bearing, a guide metal fitting, a driving pin or the like. Thus, it is believed that there is room for improvement in economical efficiency and reliability. Moreover, the displacement-transmitting mechanism is bulkier than the electromagnet, and particularly, the mass of the movable units of the displacement-transmitting mechanism is very large, which causes a problem of driving force loss or increase in response time of the electromagnet.

SUMMARY OF THE INVENTION

It is an object of the present invention to at least partially solve the problems in the conventional technology.

According to an aspect of the present invention, there is provided an operating device that performs opening and closing operations of a switch. The operating device includes a lever member that is coupled to a movable contact of the switch and biased by an energy storage spring; a tripping latch that can be engaged with the lever; a tripping trigger that can be engaged with the tripping latch; first and second electromagnets that can operate independently of each other and each of which has a plunger; and a rotating lever that can come into contact with different portions of the plunger of the first electromagnet, the plunger of the second electromagnet, and the tripping trigger and that is rotated by being pushed by at least one of the plunger of the first electromagnet and the plunger of the second electromagnet, thereby pushing the tripping trigger.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments according to the present invention will be explained below in detail with reference to the accompanying drawings. The present invention is not limited to the embodiments.

Figure 1:
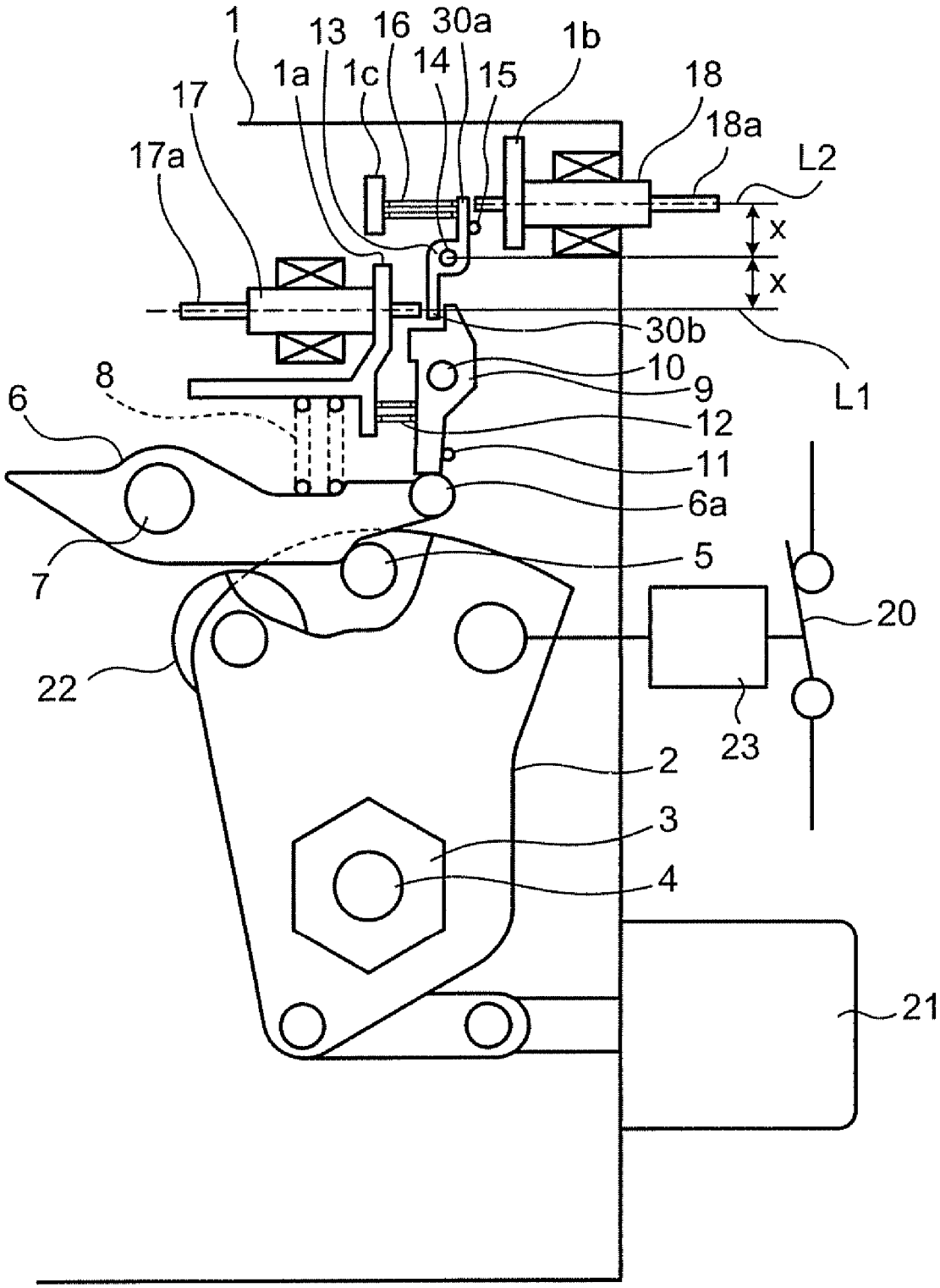
FIG. 1 is a configuration example of an operating device according to an embodiment of the present invention.

A configuration of an operating device according to an embodiment of the present invention is described with reference to FIG. 1. FIG. 1 is a configuration example of the operating device. The operating device is, for example, an operating device of a circuit breaker. FIG. 1 depicts the operating device in a closed (switched) state. A latch mechanism of the operating device is shown in FIG. 1, and other portions are the same in configuration and operation as those described in FIG. 1 of Japanese Patent Application Laid-open No. S63-304542, for example.

A lever 2 is arranged in a firmly fixed manner to a rotating shaft 3 within a casing 1 of the operating device. The rotating shaft 3 is supported to rotate freely by the casing 1 by bearings (not shown). The lever 2 is coupled to a movable contact 20 in an arc-extinguishing chamber (not shown) of a circuit breaker (not shown) via a link mechanism 23, and is also coupled to a dashpot 21 arranged outside the casing 1. The dashpot 21 cushions the shock when the movable contact 20 is opened and closed. However, in FIG. 1, the movable contact 20 is in a closed state. Moreover, a roller 22 and a pin 5 are attached to the lever 2.

A torsion bar 4 is arranged as an energy storage unit for an open circuit, and one end of this torsion bar 4 is fixed firmly to the rotating shaft 3. The torsion bar 4 serves to gain spring load due to a torsional force. A counterclockwise torque of the rotating shaft 3 is biased on the lever 2 by the torsion bar 4. However, when a tripping latch catch 6 engages with the pin 5 of the lever 2, the lever 2 is locked, thereby maintaining an energy storage state of the torsion bar 4. The tripping latch catch 6, or tripping latch, is supported by the casing 1 via a rotating shaft 7, and a clockwise torque of the rotating shaft 7 is biased on one end of the tripping latch catch 6 by a spring 8 fixed to a portion 1*a* of the casing 1.

A tripping trigger 9 comes into contact with a distal end 6*a* of the tripping latch catch 6 so that the tripping latch catch 6 is locked. The tripping trigger 9 is supported by the casing 1 via a rotating shaft 10, and a counterclockwise torque of the rotating shaft 10 is biased on one end of the tripping trigger 9 by a spring 12 fixed to the portion 1*a* of the casing 1. The tripping trigger 9 becomes stationary when it comes into contact with a stopper 11.

A rotating lever 13 is located at a position where it can come into contact with the tripping trigger 9, and is supported to rotate freely to the casing 1 by a rotating shaft 14. By a spring 16 fixed to a portion 1*c* of the casing 1, the clockwise torque of the rotating shaft 14 is biased on one end of the rotating lever 13. However, the rotating lever 13 becomes stationary when it comes into contact with a stopper 15. In the example shown in FIG. 1, the rotating lever 13 includes a first arm 30*a* and a second arm 30*b*, which are extended in a direction opposite to each other. The spring 16 biases torque on the rotating lever 13 via the first arm 30*a*.

A first electromagnet 17 is fixed to the portion 1*a* of the casing 1 and includes a plunger 17*a* capable of linear motion. A second electromagnet 18 is fixed to a portion 1*b* of the casing 1 and includes a plunger 18*a* capable of linear motion. A straight line L2 including an axis of the plunger 18*a* is located above a straight line L1 including an axis of the plunger 17*a*. The plungers 17*a* and 18*a* are positioned such that the both straight lines L1 and L2 are on the same plane and parallel. Moreover, the first electromagnet 17 and the second electromagnet 18 are positioned such that the shortest distance between the straight line L1 including the axis of the plunger 17*a* and the rotating shaft 14 and that between the straight line L2 including the axis of the plunger 18*a* and the rotating shaft 14 are equal (x).

The plunger 17*a*, the plunger 18*a*, the rotating lever 13, and the tripping trigger 9 are positioned in the same plane. Particularly, the positional relationship among the first electromagnet 17, the second electromagnet 18, the tripping trigger 9, and the rotating lever 13 is that a plane that passes through three locations, that is, a contacting portion between the plunger 17*a* of the first electromagnet 17 and the rotating lever 13, that between the plunger 18*a* of the second electromagnet 18 and the rotating lever 13, and that between the tripping trigger 9 and the rotating lever 13 is vertical to the rotating shaft 14 of the rotating lever 13.

The plunger 17*a* can come into contact with the second arm 30*b* and the plunger 18*a* can come into contact with the first arm 30*a*. A surface on which the plunger 17*a* comes into contact with the second arm 30*b* is opposite to that on which the tripping trigger 9 comes in contact with the second arm 30*b*.

Figure 2:
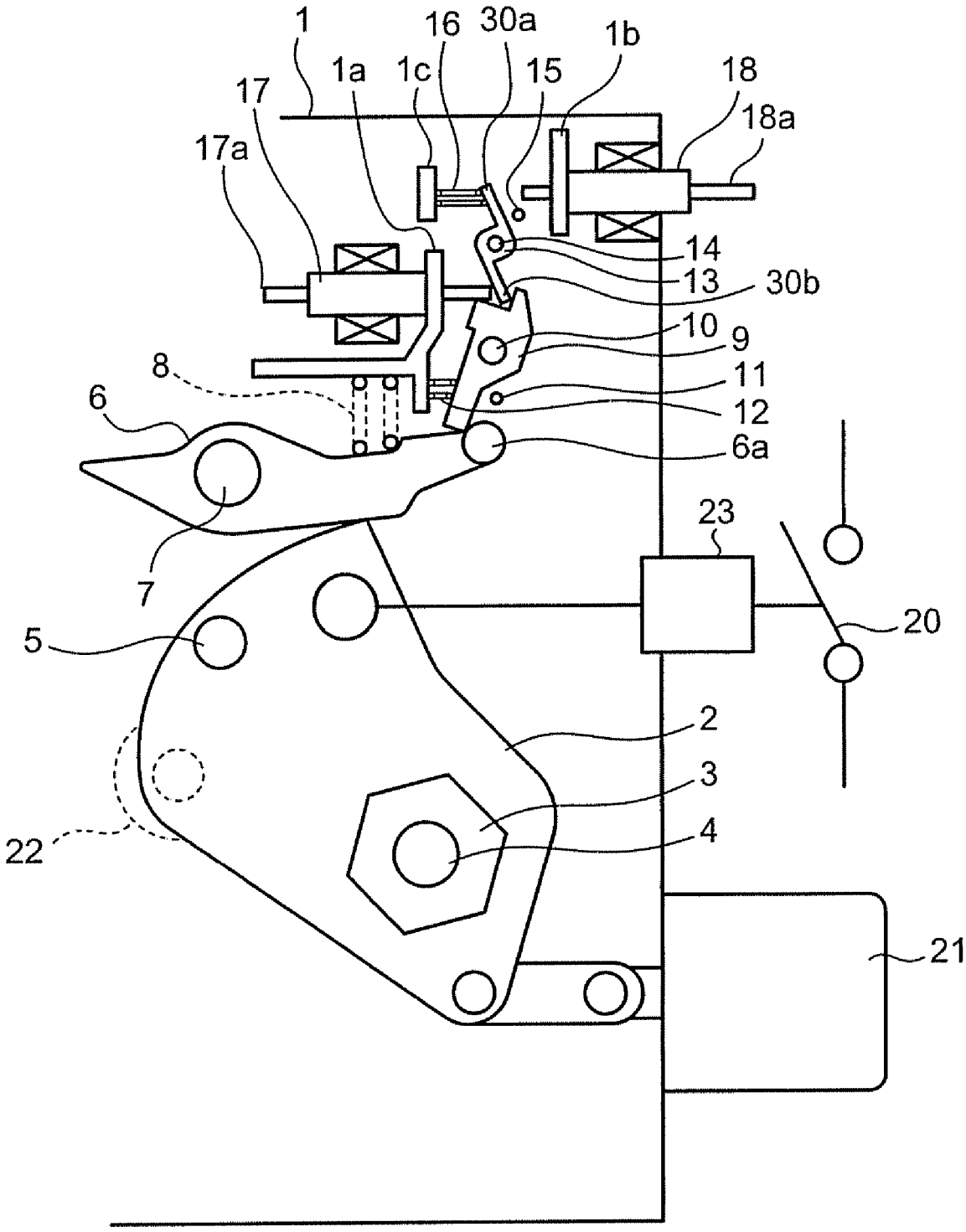
FIG. 2 depicts the operating device in an open circuit (cut-off) state.
Figure 3:
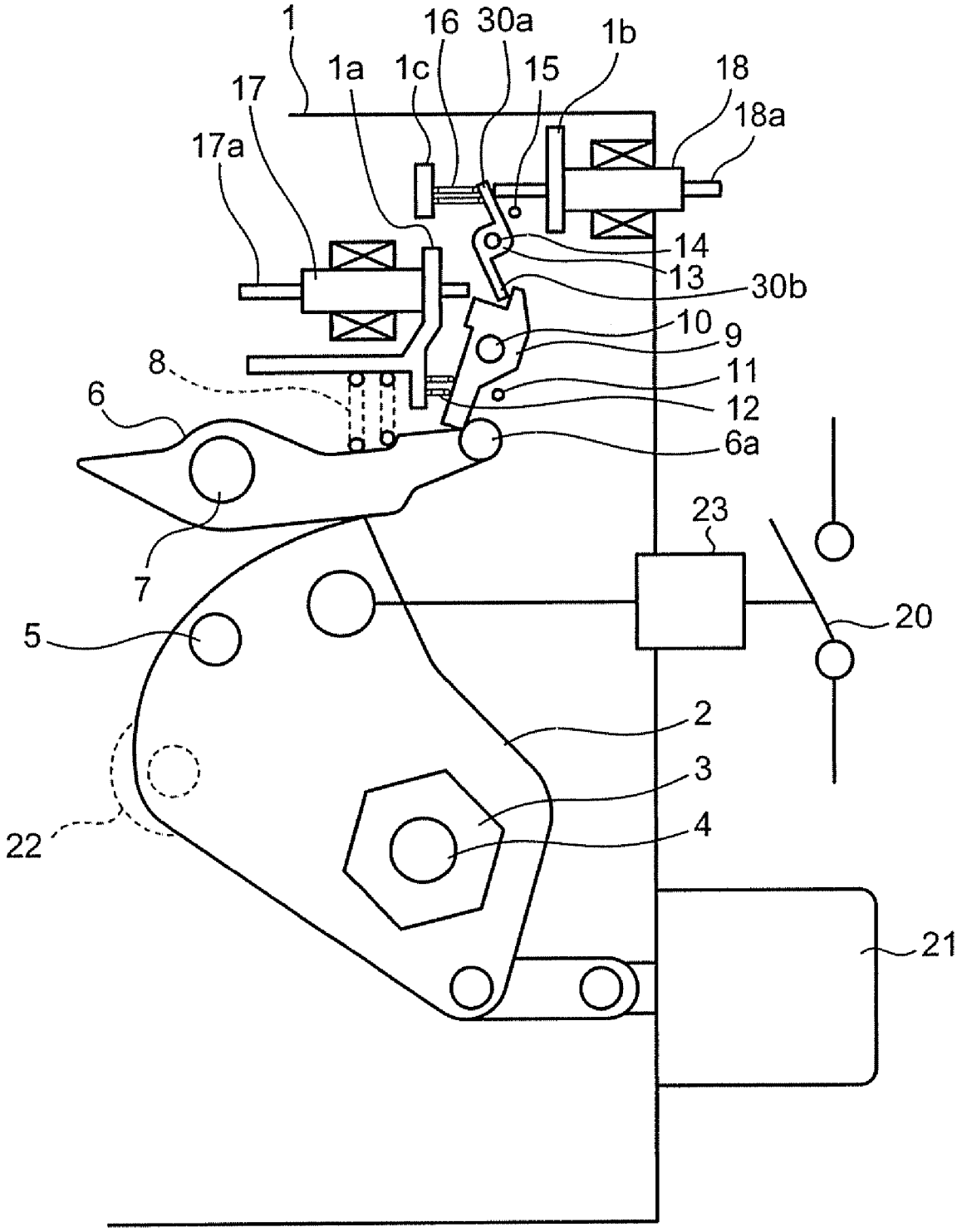
FIG. 3 is another view of the operating device in the open circuit (cut-off) state.

The operation of the present embodiment is explained next with reference to FIGS. 1 to 3. FIG. 2 depicts the operating device in an open circuit (cut-off) state, and FIG. 3 is another diagram showing the operating device in the open circuit (cut-off) state. First, the cut-off operation of the operating device is described. The cut-off operation is described individually as it is enabled by operating the first electromagnet 17 or the second electromagnet 18.

First, in the switched state in FIG. 1, when the first electromagnet 17 receives a tripping (cut-off) command signal, the plunger 17*a* of the first electromagnet 17 operates linearly and pushes the rotating lever 13. The rotating lever 13 resists the force of the spring 16 and rotates in the counterclockwise direction. When the rotating lever 13 comes into contact with the tripping trigger 9, the force of the plunger 17*a* is transmitted to the tripping trigger 9. The tripping trigger 9 resists the force of the spring 12 and rotates in the clockwise direction so that the engagement with the tripping latch catch 6 is released. The tripping latch catch 6 receives the force of the pin 5 of the lever 2 due to the spring force of the torsion bar 4, thereby resisting the force of the spring 8, and rotates in the counterclockwise direction. As a result, the engagement between the tripping latch catch 6 and the lever 2 is released, thereby starting the lever 2 to rotate in the counterclockwise direction. In this way, the cut-off operation is started, and the movable contact 20 of the arc-extinguishing chamber of the circuit breaker opens and departs. When the cut-off operation comes near the end, braking by the dashpot 21 is started, and finally, the cut-off state as shown in FIG. 2 is reached.

Next, when the second electromagnet 18 receives a tripping command signal in the switched state in FIG. 1, the plunger 18*a* of the second electromagnet 18 operates linearly to push the rotating lever 13. As a result, the rotating lever 13 rotates in the counterclockwise direction, and comes into contact with the tripping trigger 9, thereby transmitting the force of the plunger 18*a* to the tripping trigger 9. From this point onwards, the same cut-off operation as that by the first electromagnet follows, and finally, the cut-off state as shown in FIG. 3 is reached. Needless to say, a tripping operation by simultaneous operations of the first electromagnet 17 and the second electromagnet 18 is possible.

The switching operation is the same as that in an operating device of the conventional torsion-bar system as described in Japanese Patent Application Laid-open No. S63-304542. That is, when a switching mechanism (not shown) receives a switching command signal in the cut-off state in FIG. 2, a cam (not shown) of a portion of the switching mechanism comes into contact with the roller 22, and the switching force is transmitted to the lever 2. Simultaneously with the rotation of the lever 2 in the clockwise direction while the lever 2 causes the torsion bar 4 to store energy, the movable contact 20 of the arc-extinguishing chamber starts switching. The braking is started by the dashpot 21 when the switching operation comes near the end, and the lever 2 is at a switching position as shown in FIG. 1. At this time, the tripping latch catch 6 is rotated in the clockwise direction by the force of the spring 8 to be engaged with the pin 5 of the lever 2. The tripping trigger 9 is rotated in the counterclockwise direction until it comes into contact with the stopper 11 by the force of the spring 12, and as a result, the tripping latch catch 6 is locked. Thereafter, the cam (not shown) is departed from the roller 22. However, the energy storage state of the torsion bar 4 is maintained because the lever 2 is engaged with the tripping latch catch 6. The rotating lever 13 is rotated in the clockwise direction by the force of the spring 16, and stops at a position where it comes into contact with the stopper 15. The switching state as shown in FIG. 1 is thus established.

The energy storage operation of a torsion bar (not shown) for switching after the end of the switching operation is the same as that in an operating device of the conventional torsion bar system as described in Japanese Patent Application Laid-open No. S63-304542.

As described above, in the operating device according to the present embodiment, the first electromagnet 17 and the second electromagnet 18, which are two electromagnets, can operate on the rotating lever 13 independently. Accordingly, even when one electromagnet breaks down mechanically or electrically, the tripping latch can be operated by the other electromagnet. In this way, the redundancy of the latch mechanism is secured. At this time, when the rotating lever 13 is used as a force-transmitting mechanism from either the first electromagnet 17 or the second electromagnet 18 to the tripping trigger 9, the force-transmitting mechanism can be simply configured. Thus, the reliability for the mechanism improves.

The rotating lever 13 and the tripping trigger 9 can be of small size and light weight. As a result, the latch mechanism can be engaged and disengaged at high speed, which provides an effect of improved operability and stability.

With reference to the rotating shaft 14 of the rotating lever 13, moment arms of the plunger 17*a* of the first electromagnet 17 and the plunger 18*a* of the second electromagnet 18 are the same (distance x in FIG. 1). Therefore, electromagnets of the same operating force specification can be applied.

Further, because the plunger 17*a*, the plunger 18*a*, the rotating lever 13, and the tripping trigger 9 are positioned in the same plane, they can be occupied in a smaller space. As a result, the rotating lever 13 and the tripping trigger 9 can be downsized and lightweight, thereby improving the dynamic characteristic of the latch mechanism.

Figure 4:
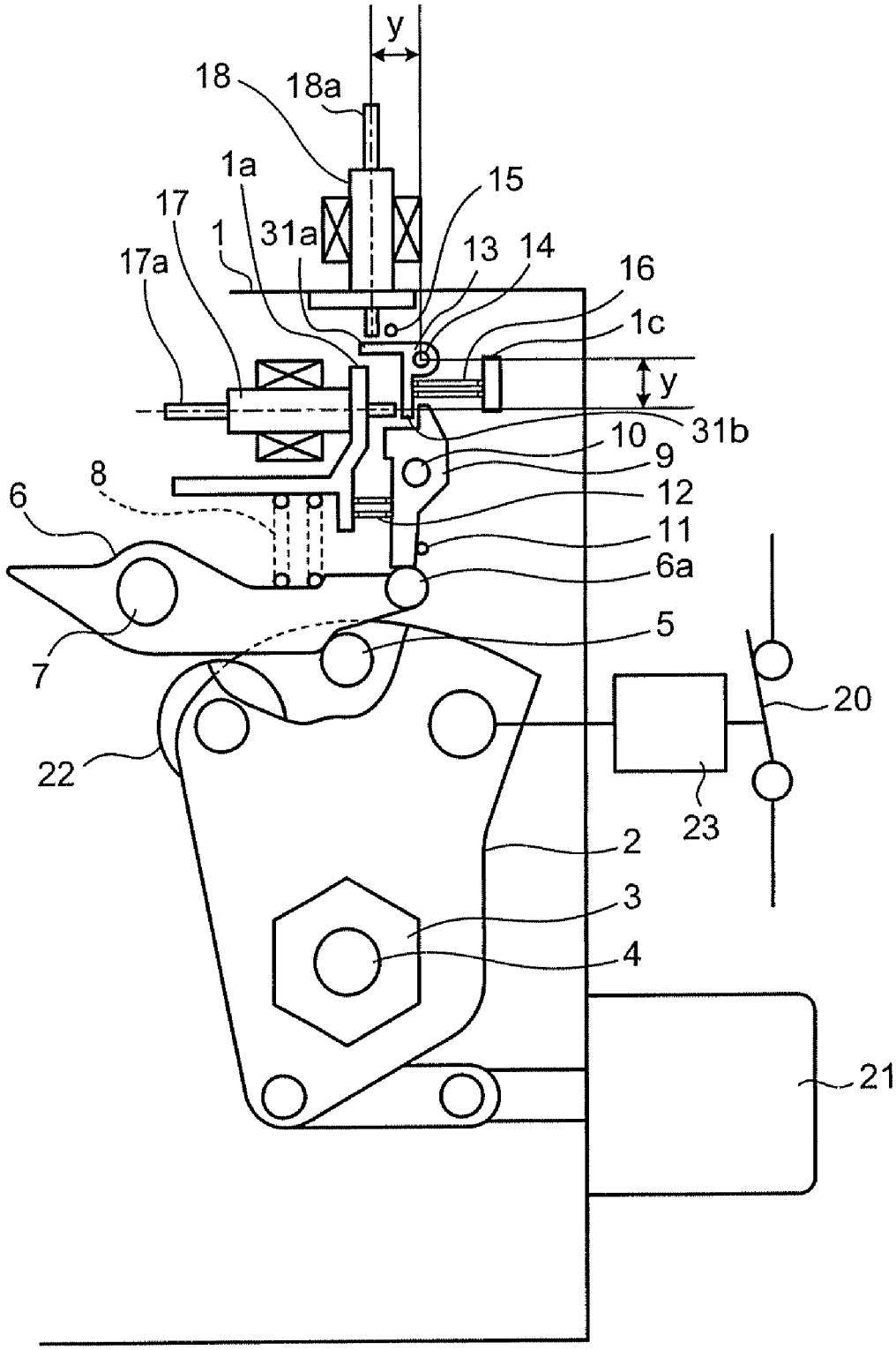
FIG. 4 depicts a configuration example of an operating device according to another embodiment.

FIG. 4 depicts a configuration example of an operating device according to another embodiment of the present invention. In FIG. 1, the first electromagnet 17 and the second electromagnet 18 are positioned such that the straight line L1 including the axis of the plunger 17*a* and the straight line L2 including the axis of the plunger 18*a* are horizontal.

On the other hand, FIG. 4 depicts an arrangement such that the straight line including the axis of the plunger 17*a* of the first electromagnet 17 and the straight line including the axis of the plunger 18*a* of the second electromagnet 18 are perpendicular, for example. That is, the second electromagnet 18 is attached on the top surface of the casing 1 and the plunger 18*a* operates in the up-down direction. Moreover, a first arm 31*a* and a second arm 31*b*, which are two arms of the rotating lever 13, are extended to be perpendicular to each other. The first arm 31*a* can come into contact with the plunger 18*a* and the second arm 31*b* can come into contact with the plunger 17*a*. On the rotating lever 13, the clockwise torque is biased by the spring 16 fixed to the portion 1*c* of the casing 1. A surface on which the plunger 17*a* comes into contact with the second arm 31*b* is opposite to that on which the tripping trigger 9 comes into contact with the second arm 31*b*. As shown in FIG. 4, the first electromagnet 17 and the second electromagnet 18 are positioned such that the shortest distance between a straight line including the axis of the plunger 17*a* and the rotating shaft 14 and that between a straight line including the axis of the plunger 18*a* and the rotating shaft 14 are the same (y). The operating device shown in FIG. 4 can also provide the same effect as that shown in FIG. 1. Note that when the angle formed by the straight line including the axis of the plunger 17*a* and the straight line including the axis of the plunger 18*a* and the angle formed by the extending directions of the two arms of the rotating lever 13 are adjusted, the configurations other than those in FIG. 1 and FIG. 4 are possible.

Figure 5:
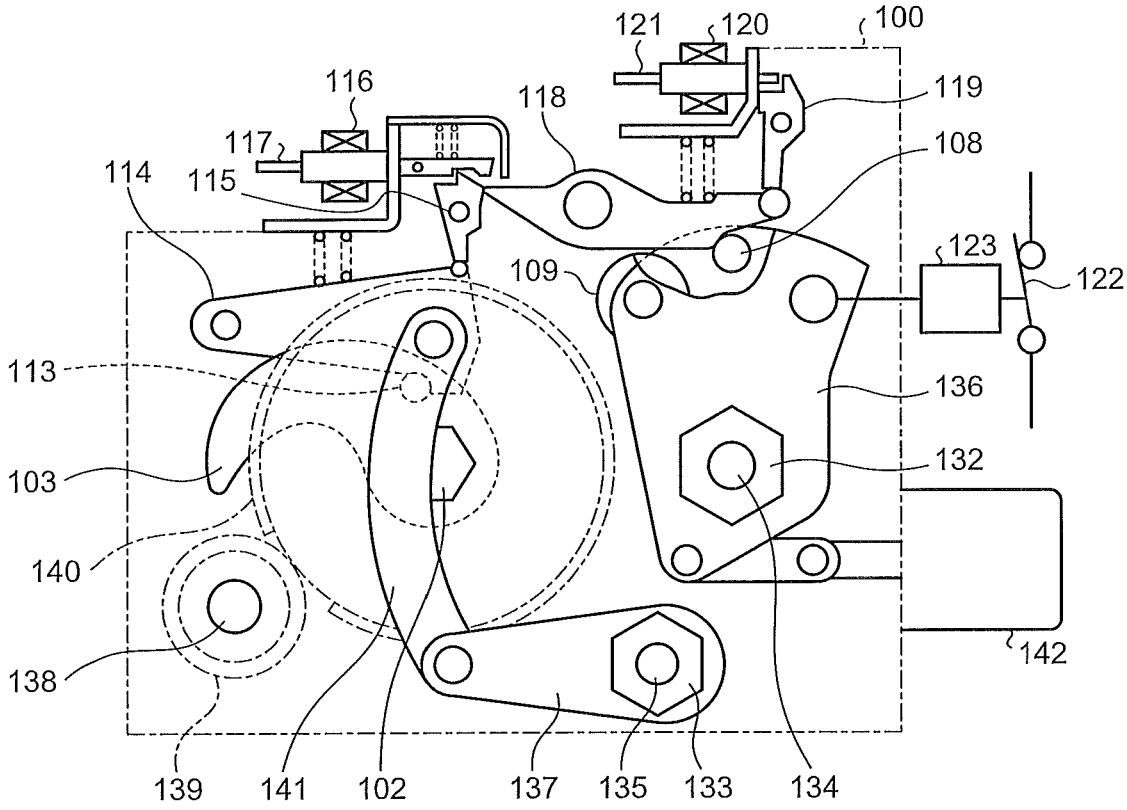
FIG. 5 Prior Art
FIG. 5 is a configuration example of a conventional operating device.

FIG. 5 is a configuration example of the conventional operating device, and corresponds to FIG. 1 of Japanese Patent Application Laid-open No. S63-304542. In FIG. 5, a cam shaft 102 is supported in a casing 100, and a cam 103 is mounted on the cam shaft 102. A pin 113 is arranged in the cam 103. One end of a torsion bar 135 is firmly fixed to a rotating shaft 133. A lever 137 is firmly fixed to the rotating shaft 133. A rotating shaft 138 supported to the casing 100 is driven in the counterclockwise direction by a motor (not shown). A small toothed gear 139 is firmly fixed to the rotating shaft 138. The small toothed gear 139 is configured such that it is meshed with a large toothed gear 140 firmly fixed to the cam shaft 102. The large toothed gear 140 lacks a portion of the teeth so that the meshing with the small toothed gear 139 is undone when the torsion bar 135 is in a state that energy is stored. The lever 137 and the large toothed gear 140 are coupled by a lever 141. A switching latch 114 is engaged with the pin 113. A switching trigger 115 is engaged with the switching latch 114. A switching electromagnet 116 includes a plunger 117.

In FIG. 5, one end of a torsion bar 134 is firmly fixed to a rotating shaft 132. A lever 136 is firmly fixed to the rotating shaft 132, and is applied a counterclockwise rotating force by the torsion bar 134. The lever 136 is coupled to a movable contact 122 of the circuit breaker via a link mechanism 123, and also coupled to a shock absorber 142 that cushions the shock during opening and closing operations. A pin 108 and a roller 109 are arranged in the lever 136. A tripping latch 118 is engaged with the pin 108. A tripping trigger 119 is engaged with the tripping latch 118. A tripping electromagnet 120 includes a plunger 121.

As is understood from a comparison between FIG. 5 and FIG. 1, the constituent elements of the present embodiment shown in FIG. 1 are the rotating shaft 132, the torsion bar 134, the lever 136, the pin 108, the roller 109, the tripping latch 118, the tripping trigger 119, the tripping electromagnet 120, the plunger 121, the movable contact 122, the link mechanism 123 and the shock absorber 142 in FIG. 5. The switching mechanism omitted in FIG. 1 can be considered as a switching mechanism including the cam 103 or the like in FIG. 5, for example. The operation of FIG. 5 is omitted because it is described in Japanese Patent Application Laid-open No. S63-304542.

As shown in FIG. 5, in the conventional operating device, there is no redundancy because only one tripping electromagnet 120 is arranged. However, in the present embodiment, two electromagnets, that is, the first electromagnet 17 and the second electromagnet 18, are arranged as the tripping electromagnets, and thus redundancy is secured.

Figure 6:
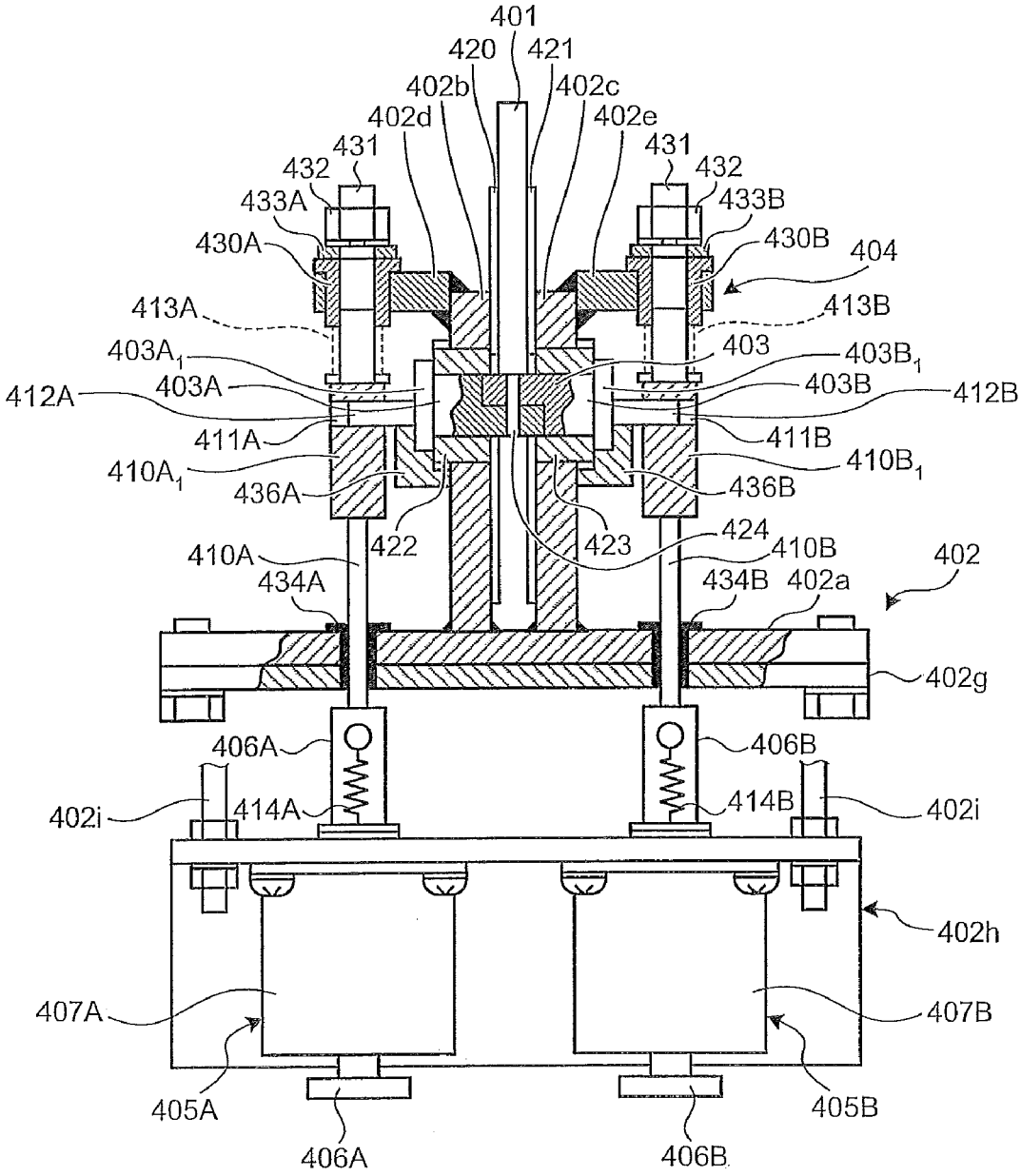
FIG. 6 Prior Art
FIG. 6 is another configuration example of the conventional operating device.

FIG. 6 depicts another configuration example of the conventional operating device (see FIG. 2 of Japanese Patent Application Laid-open No. H09-320407). Among the configurations of the conventional operating device shown in FIG. 6, only portions directly relevant to the present embodiment are generally explained. In this conventional operating device (tripping device), a hook 401 is supported to rotate freely by vertical plates 402*b* and 402*c* of a frame 402, and is also coupled to a link (not shown) of an operating mechanism (not shown). The hook 401 is a lever arranged to rotate between a switching position at which equilibrium at the time of switching the operating mechanism is maintained and a tripping position where the equilibrium of the operating mechanism is broken to perform a cut-off operation.

Bearings 422 and 423 are attached to holes arranged in the vertical plates 402*b* and 402*c*, respectively. Inside the bearings, a latch catch 403 is supported to rotate freely. A first driving pin 412A and a second driving pin 412B are attached respectively to end surfaces of one and the other ends in an axial line direction of the latch catch 403. Projected portions 402*d* and 402*e* of the frame 402 have through holes that vertically extend in the positions corresponding to the first and second driving pins 412A and 412B, respectively. A first guide clasp 430A and a second guide clasp 430B are fitted into the through holes.

In a base plate 402*a* and a flat plate 402*g* of the frame 402, the through holes that share the axial lines with the first guide clasp 430A and the second guide clasp 430B, respectively, are arranged. A first thrust bearing 434A and a second thrust bearing 434B are attached to these through holes, respectively.

An inner hole of the first guide clasp 430A and the first thrust bearing 434A are slidably fitted with a first lifting rod 410A. An inner hole of the second guide clasp 430B and the second thrust bearing 434B are slidably fitted with a second lifting rod 410B. The first and second driving pins 412A and 412B are arranged at an eccentric position on the end surface of the latch catch 403, and thus, when the first and second lifting rods 410A and 410B are displaced in the up-down direction, the latch catch 403 rotates. The first and second lifting rods 410A and 410B are biased downwardly by return springs 413A and 413B, respectively, and due to the biased force of these return springs 413A and 413B, the latch catch 403 is biased to a permanent locking position side.

In a lower supporting frame 402*h* of the frame, a first electromagnet 405A and a second electromagnet 405B are arranged in parallel to each other, forming a line in the lateral direction. The first electromagnet 405A, which includes a first plunger 406A and a first tripping coil 407A, is configured such that the first plunger 406A is driven to be displaced upwardly when the first tripping coil 407A is pumped. Moreover, the second electromagnet 405B, which includes a second plunger 406B and a second tripping coil 407B, is configured such that the second plunger 406B is driven to be displaced upwardly when the second tripping coil 407B is pumped.

The first plunger 406A and the second plunger 406B are biased downwardly (opposite to the first and second lifting rods 410A and 410B) by return springs 414A and 414B, respectively.

In FIG. 6, a displacement-transmitting mechanism that respectively transmits the displacements of the first plunger 406A and the second plunger 406B to the latch catch 403 in order to rotate the latch catch 403 toward an unlocking position is configured by the first and second lifting rods 410A and 410B, the first driving pin 412A and the second driving pin 412B, and the return springs 413A and 413B. A latch-catch driving mechanism 404 is configured by this displacement-transmitting mechanism, the first electromagnet 405A, and the second electromagnet 405B.

In the conventional operating device in FIG. 6, the displacement-transmitting mechanism has a complex structure as it is configured by a large number of components such as the first and second lifting rods 410A and 410B, the first and second thrust bearings 434A and 434B, the first and second guide clasps 430A and 430B, and the first and second driving pins 412A and 412B. Moreover, the displacement-transmitting mechanism is larger as compared to the first electromagnet 405A and the second electromagnet 405B, and the mass of the movable unit of the displacement-transmitting mechanism is particularly large. As a result, there is a problem that the first electromagnet 405A and the second electromagnet 405B are lost or a response time is increased.

On the other hand, in the present embodiment, a force-transmitting mechanism from the plunger 17*a* of the first electromagnet 17 and the plunger 18*a* of the second electromagnet 18 to the tripping trigger 9 is simply structured. Particularly, when the rotating lever 13 is arranged, the two electromagnets do not act directly on the tripping trigger 9. With such a configuration, the tripping trigger 9 can be miniaturized. On the contrary, when the two electromagnets act directly on the tripping trigger 9, the tripping trigger 9 becomes large. As a result, the engaging operability (stability) of the tripping trigger 9 with the latch (the tripping latch catch 6) deteriorates.

Descriptions of other constituent elements in FIG. 6 such as spacers 420 and 421, flanges 403A1 and 403B1, a bolt 431, a nut 432, long holes 411A and 411B, expanded diameter portions 410A1 and 410B1, binder plates 433A and 433B, a first half portion 403A, a second half portion 403B, stoppers 436A and 436B, a pin 424, return springs 414A and 414B, a bolt 402*i* are omitted.

According to an aspect of the present invention, the reliability of an operating device of a switching device can be improved. In addition, engaging and disengaging of the latch mechanism can be made at high speed, thereby improving its operability and stability.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An operating device that performs opening and closing operations of a switch, the operating device comprising:

a lever member that is coupled to a movable contact of the switch and biased by an energy storage spring;

a tripping latch that can be engaged with the lever member;

a tripping trigger that can be engaged with the tripping latch;

first and second electromagnets that can operate independently of each other and each of which has a plunger; and a rotating lever that can come into contact with different portions of the plunger of the first electromagnet, the plunger of the second electromagnet, and the tripping trigger and that is rotated by being pushed by at least one of the plunger of the first electromagnet and the plunger of the second electromagnet, thereby pushing the tripping trigger.

2. The operating device according to claim 1, wherein the rotating lever includes a first arm and a second arm that extend in a direction opposite to each other, the plunger of the first electromagnet comes into contact with the first arm, and the plunger of the second electromagnet comes into contact with the second arm.

3. The operating device according to claim 2, wherein a shortest distance between a straight line including an axis of the plunger of the first electromagnet and a rotating shaft of the rotating lever and a shortest distance between a straight line including an axis of the plunger of the second electromagnet and the rotating shaft of the rotating lever are equal.

4. The operating device according to claim 2, wherein the first electromagnet, the second electromagnet, the tripping trigger, and the rotating lever are positioned such that a plane that passes through three locations, which are a contacting portion between the plunger of the first electromagnet and the rotating lever, a contacting portion between the plunger of the second electromagnet and the rotating lever, and a contacting portion between the tripping trigger and the rotating lever, is vertical to the rotating shaft of the rotating lever.

5. The operating device according to claim 1, wherein the rotating lever includes a first arm and a second arm that extend in a direction perpendicular to each other, the plunger of the first electromagnet comes into contact with the first arm, and the plunger of the second electromagnet comes into contact with the second arm.

6. The operating device according to claim 5, wherein a shortest distance between a straight line including an axis of the plunger of the first electromagnet and a rotating shaft of the rotating lever and a shortest distance between a straight line including an axis of the plunger of the second electromagnet and the rotating shaft of the rotating lever are equal.

7. The operating device according to claim 5, wherein the first electromagnet, the second electromagnet, the tripping trigger, and the rotating lever are positioned such that a plane that passes through three locations, which are a contacting portion between the plunger of the first electromagnet and the rotating lever, a contacting portion between the plunger of the second electromagnet and the rotating lever, and a contacting portion between the tripping trigger and the rotating lever, is vertical to the rotating shaft of the rotating lever.

8. The operating device according to claim 1, wherein the first electromagnet, the second electromagnet, the tripping trigger, and the rotating lever are positioned such that a plane that passes through three locations, which are a contacting portion between the plunger of the first electromagnet and the rotating lever, a contacting portion between the plunger of the second electromagnet and the rotating lever, and a contacting portion between the tripping trigger and the rotating lever, is perpendicular to the rotating shaft of the rotating lever.

9. The operating device according to claim 1, wherein the rotating lever has two ends which can respectively come into contact with the different portions of the plungers of the first and second electromagnets, and a center point about which the rotating lever rotates, the center point being at an equal distance between the two ends.

10. The operating device according to claim 1, wherein the rotating lever includes a first arm and a second arm that extend in different directions and which can come into contact with the plunger of the first electromagnet and the plunger of the second electromagnet, respectively, the first and second arms being rigidly fixed to the rotating lever so that the first and second arms do not move relative to each other.

11. The operating device according to claim 1, wherein the plunger of the first electromagnet is parallel to the plunger of the second electromagnet.

12. The operating device according to claim 1, wherein the tripping trigger can be pushed by the rotating lever by an independent operation of either one of the first and second electromagnets.

13. An operating device that performs opening and closing operations of a switch, the operating device comprising:

a lever member that is coupled to a movable contact of the switch and biased by an energy storage spring;

a tripping latch that can be engaged with the lever member;

a tripping trigger that can be engaged with the tripping latch;

first and second electromagnets that can operate independently of each other and each of which has a plunger; and a rotating lever that can come into contact with different portions of the plunger of the first electromagnet, the plunger of the second electromagnet, and the tripping trigger and that is rotated by being pushed by at least one of the plunger of the first electromagnet and the plunger of the second electromagnet, thereby pushing the tripping trigger, wherein a shortest distance between a straight line including an axis of the plunger of the first electromagnet and a rotating shaft of the rotating lever and a shortest distance between a straight line including an axis of the plunger of the second electromagnet and the rotating shaft of the rotating lever are equal.

14. The operating device according to claim 13, wherein the first electromagnet, the second electromagnet, the tripping trigger, and the rotating lever are positioned such that a plane that passes through three locations, which are a contacting portion between the plunger of the first electromagnet and the rotating lever, a contacting portion between the plunger of the second electromagnet and the rotating lever, and a contacting portion between the tripping trigger and the rotating lever, is vertical to the rotating shaft of the rotating lever.

* * * * *